United States Patent [19]

Minkin

[11] 4,143,669

[45] Mar. 13, 1979

[54] POWER PARTS WASHER

[75] Inventor: Gary E. Minkin, St. Louis, Mo.

[73] Assignee: The Mart Corporation, Clayton, Mo.

[21] Appl. No.: 805,305

[22] Filed: Jun. 10, 1977

[51] Int. Cl.[2] ..... B08B 3/02

[52] U.S. Cl. ..... 134/153; 134/200

[58] Field of Search ..... 134/112, 115 R, 140, 134/143, 153, 200

[56] References Cited

U.S. PATENT DOCUMENTS

| | | | |
|---|---|---|---|
| 1,762,847 | 6/1930 | Webb | 134/112 UX |
| 2,443,091 | 6/1948 | Zademach | 134/153 X |
| 3,060,946 | 10/1962 | Lantz | 134/140 X |
| 3,133,547 | 5/1964 | Dannenmann et al. | 134/112 |
| 3,448,744 | 6/1969 | Szczepanski | 134/153 X |

FOREIGN PATENT DOCUMENTS

| | | | |
|---|---|---|---|
| 10632 | 12/1933 | Australia | 134/200 |

*Primary Examiner*—Robert L. Bleutge

*Attorney, Agent, or Firm*—Wegner, Stellman, McCord, Wiles & Wood

[57] ABSTRACT

A power washer with a cabinet having liquid spray structure for cleaning of parts, such as automobile parts, and having a circular turntable within the cabinet for support of parts to be washed. The turntable is driven by a drive structure located exteriorly of the cabinet and having a drive wheel extended through an opening in a side wall of the cabinet to engage with a rim of the turntable to cause rotation thereof. The turntable is mounted for movement between an operating position within the cabinet and a part loading and unloading position outside the cabinet by movement through a front opening in the cabinet. A door is mounted on the movable support structure for the turntable whereby the door and turntable move together and a latch holds the door closed and causes the turntable to firmly engage said drive wheel. Additionally, stabilizer members are provided for removable attachment to the turntable to engage an unstable part positioned on the turntable and hold the part in position during turntable movement.

4 Claims, 6 Drawing Figures

POWER PARTS WASHER

BACKGROUND OF THE INVENTION

This invention pertains to a power washer having structure for washing of parts, such as automotive parts, with improved turntable structure for part loading and unloading and handling and a turntable friction drive with electrical parts located exteriorly of the washer and not exposed to the washing liquid.

It is known to have power washers for parts, such as automobile parts, wherein the parts are positioned on a rotatable turntable; however, the prior art has not had a drive structure for the turntable located exteriorly of the cabinet to not be contacted by washing liquid and to be readily disengageable from the turntable to permit movement of the turntable between an operating position within the cabinet and a loading-unloading position located generally outside the cabinet.

SUMMARY OF THE INVENTION

A primary feature of the invention disclosed herein relates to a power washer having a rotatable turntable which is powered by drive means located exteriorly of the cabinet to be outside of the washing environment and having a drive interconnecting means extended through the cabinet wall for driving of the turntable. Additionally, the drive-connecting means is in the form of a drive wheel engaging a rim of the turntable whereby the turntable may readily be moved from an operating position in engagement with the drive wheel to a parts loading-unloading position outside of the cabinet.

An object of the invention is to provide a power washer having a cabinet with liquid spray means therein, a circular turntable within the cabinet for support of parts to be washed and having a rim around the periphery, means for rotatably mounting the turntable, drive means for the turntable mounted outside the cabinet, an opening in the cabinet wall at the level of said turntable, and drive-transmitting means extending through said opening to transmit a turntable drive from said drive means to said turntable.

Another object of the invention is to provide a power washer as defined in the preceding paragraph wherein the drive-transmitting means is in the form of a drive wheel extending through the cabinet wall opening and said turntable is mounted for movement between an operating position and a loading-unloading position by means of an arm having an outer end pivotally-mounted to the cabinet at the exterior thereof and with an opposite end carrying the turntable and with a door for closing a front opening in the cabinet carried by said arm and movable with the turntable.

Still another object of the invention is to provide a power washer utilizing a stabilizer member usable for support of an unbalanced part carried by the turntable with the turntable being made up of vertically disposed planar members and with the stabilizer member being in the form of a bar removably attachable by a bifurcated lower section to a plurality of said turntable planar members extending at angles to each other and with an upper section thereof extending above the turntable for engagement with a part to be stabilized.

DESCRIPTION OF THE PREFERRED EMBODIMENT

Figure 1:
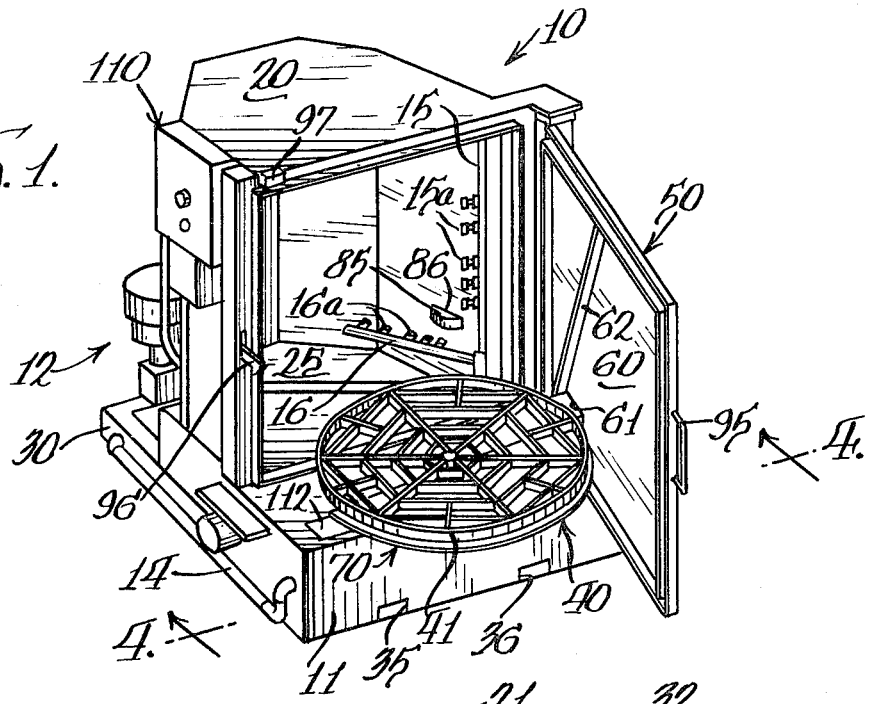
FIG. 1 is a perspective view of the power washer, looking toward the front thereof and with the structure in a parts loading-unloading position.
Figure 2:
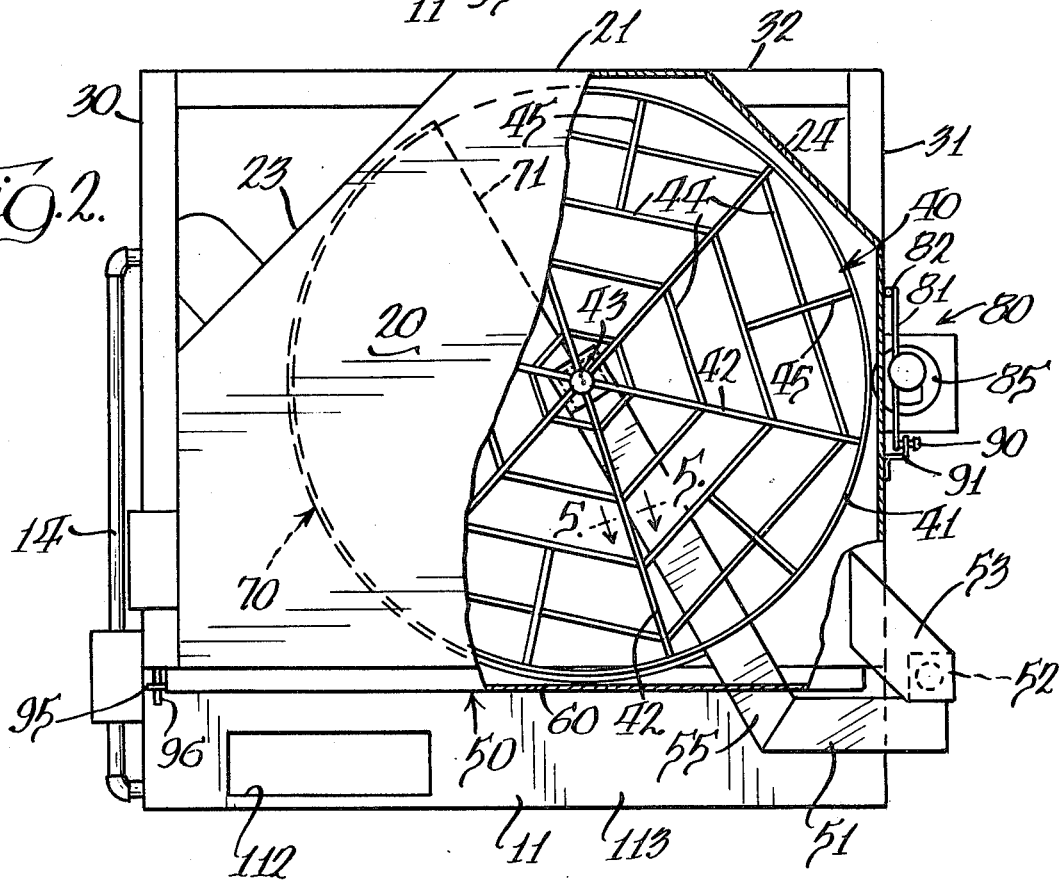
FIG. 2 is a plan view of the structure shown in FIG. 1 and with the structure shown in a closed operating position and with parts broken away.
Figure 3:
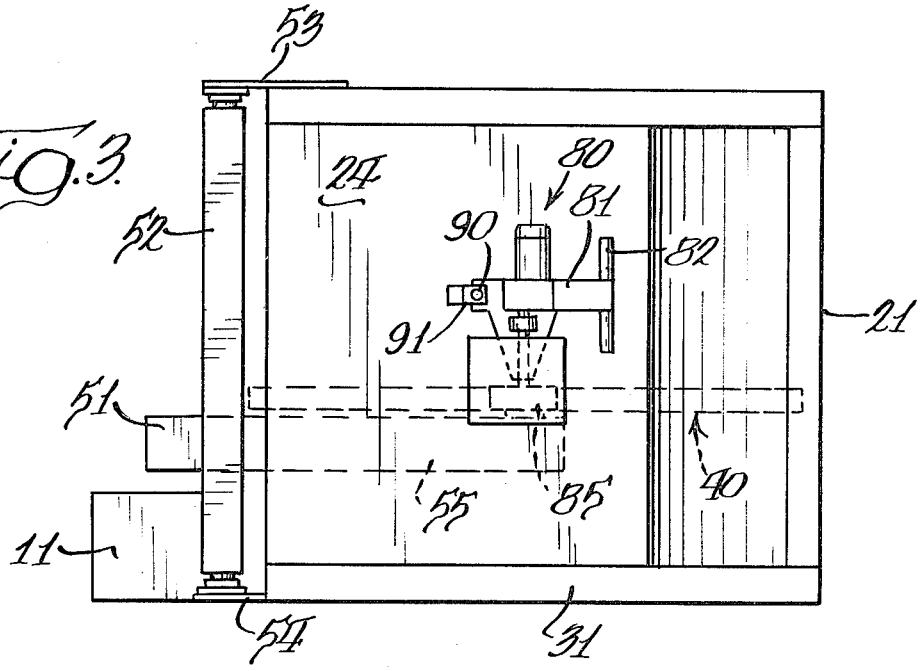
FIG. 3 is a side elevational view, looking toward the right-hand side as viewed in FIG. 2.

The power washer is shown generally in FIGS. 1 to 3 and has a cabinet, indicated generally at 10, with a base 11 forming a liquid reservoir for collecting liquid from the cabinet interior and supplying cleaning liquid through a pipe 14 to a pump, indicated generally at 12, which supplies liquid to a vertically-extending spray arm 15 and a horizontally-extending spray arm 16 positioned within the cabinet.

The vertically-extending spray arm 15 has spray nozzles **15*a*** with variable spacing. The lowermost nozzles are fairly close together as compared to the nozzles at the upper end of the spray arm. This directs more cleaning fluid to the underside of automotive parts being washed which are the surfaces which collect most road dirt and lubricant leakage.

In addition to the horizontal spray arm 16 at the bottom of the cabinet, there is an upper horizontal spray arm (not shown). These spray arms have the nozzles **16*a* which are grouped predominantly at the section of the spray arm adjacent the vertical spray arm 15 in order to direct more fluid toward the outer part of a turntable (to be described) which has more travel relative to the nozzles 16*a*** than the inner part of the turntable.

The cabinet 10 has a top wall 20, a rear wall 21 and side walls 23 and 24, forming a cabinet having a front opening and overlying a bottom panel 25, forming the top of the base 11. The bottom panel 25 has suitable openings to direct liquid to the reservoir.

For support, the base has side members 30 and 31 and a rear member 32, all of which are interconnected to form a solid support for the power washer and with transport of the power washer being facilitated by openings 35 and 36 for insertion of pallet forks.

This structure enabling transport of the power washer provides many advantages. The power washer in using heated liquid has a heat exchanger capability and, thus, can be used indoors in winter for heating the surrounding area and, in summer, can be moved outdoors. Also, after an accumulation of sludge is removed from washed parts, the power washer can be moved to a discharge location, since, in some locations, there can not be discharge into the sewer lines. Transport of the unit only requires electrical and hose disconnections.

The power washer has a turntable, indicated generally at 40, of circular shape. The turntable is made up of a plurality of planar members with one planar member 41 being curved to form a peripheral rim for the turntable and with a series of radial spokes 42 extending from a hub 43 to the rim 41. A series of additional planar members 44 extend between each pair of spokes 42, with the outermost member 44 being of two parts and connected to a relatively short radially-extending planar member 45. For a purpose to be described subsequently, the rim member 41 and radial spokes 42 are of a width greater than the remainder of the planar members forming the turntable. All of the planar members are oriented vertically to have their width extending vertically and the upper edges of all the planar members are at the same level and the lower edges of the planar members 44 and 45 are at an elevation higher than the lower edges of the members 41 and 42.

The turntable is mounted for movement between an operating position within the cabinet, as shown in FIG. 2, and a parts loading-unloading position positioned substantially outside of the cabinet and as shown in FIG. 1, with this movement being through a front opening of the cabinet, which is closed by a movable door, indicated generally at 50. The means for mounting of the turntable for bodily movement includes a generally L-shaped arm having an outer section 51 with an outer end thereof connected to a vertically-extending post 52 which is mounted by bearing means (not shown) to an upper bracket 53 and a lower bracket 54 extending out from the cabinet whereby the turntable mounting arm and the post 52 can rotate between the positions shown in FIGS. 1 and 2. A major length 55 of the mounting arm has an inner end 56 with bearing means (not shown) for rotatably mounting the turntable 40.

As shown particularly in FIG. 1, the door 50 is planar, with a door panel 60 having a supporting framework and with there being an opening 61 in the door panel 60 through which the arm section 55 extends. The arm section is rigidly attached to the door panel 60 and a door brace member 62 whereby the door 50 is carried on the mounting arm for movement with the turntable between the positions shown in FIGS. 1 and 2.

Figure 4:
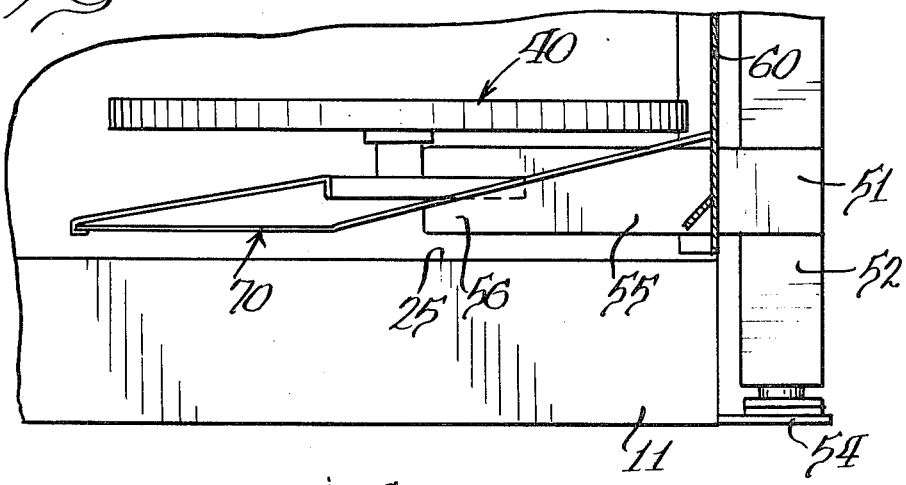
FIG. 4 is a fragmentary vertical section, taken generally along the line 4—4 in FIG. 1 and on an enlarged scale.

A turntable drip pan, indicated generally at 70 in FIG. 4, is supported from the mounting arm and underlies approximately ½ of the area of the turntable, with a leading edge thereof indicated in broken line at 71 in FIG. 2 to not interfere with liquid spray delivered from the spray arm 16 upwardly through the turntable. As shown in FIG. 1, when the turntable is in parts loading-unloading position, the drip pan prevents any liquid dripping on the floor surrounding the power washer. The drip pan slopes toward the top of the reservoir in the base whereby liquid may flow through a suitable opening into the reservoir.

The drive means for the turntable includes an electric motor and gear reduction unit, indicated generally at 80 in FIGS. 2 and 3, which is mounted on a bracket 81 exteriorly of the cabinet, with the bracket being pivotally mounted on a mounting rod 82 for movement of the drive means toward and away from the side wall 24 of the cabinet. The output shaft of the gear reducer mounts a drive wheel 85 which may be in the form of a rubber tire which extends through an opening 86 in the cabinet side wall 24 at the level of the turntable rim 41. As shown in FIG. 2, with the turntable in operating position, the drive wheel 85 engages the turntable rim 41 whereby rotation is imparted to the turntable. The compressive engagement between the drive wheel and the turntable rim may be controlled by an adjustment screw 90 carried by a bracket 91 secured to the cabinet side wall 24 and engageable with an end of the pivoted bracket 81 whereby advance of the adjusting screw moves the bracket 81 towards the cabinet side wall to increase the force of engagement between the drive wheel and the turntable rim. With this construction, the electric motor and associated structure, except for the drive wheel, are located outside of the cabinet and are not subjected to liquid within the cabinet. Additionally, the drive provided between the drive wheel and the turntable rim enables free movement of the turntable between the positions shown in FIGS. 1 and 2 without the operator having to disconnect any drive. Further, the drive wheel 85 in operation is wet and can slip and thus provides a safety clutch if a part shifts on the turntable and contacts the spray arm **15*a*** to block turntable rotation.

The door 50 has a handle 95 to facilitate movement of the door and turntable between the various positions, with the cabinet mounting a latch 96 engageable with the door to hold the door closed and by the interconnection through the arm section 55 hold the turntable rim against the drive wheel 85. An interlock 97 signals the control circuit associated with the power washer that the door is closed and the unit is ready for a wash cycle.

Figure 5:
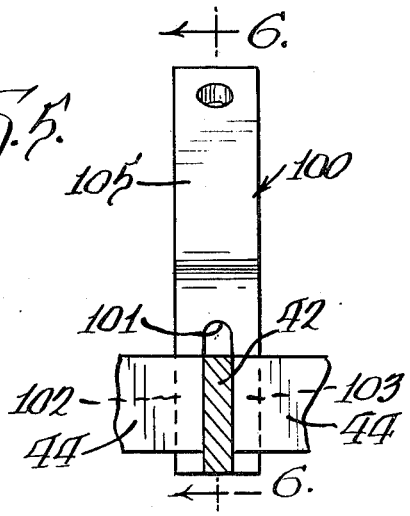
FIG. 5 is a front elevational view of a stabilizer member shown in association with the turntable of the power washer generally at the location of the line 5—5 in FIG. 2.
Figure 6:
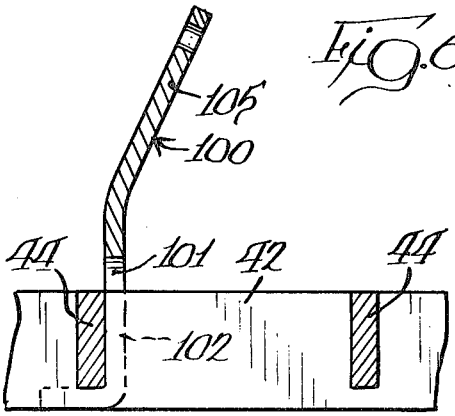
FIG. 6 is a vertical section, taken generally along the line 6—6 in FIG. 5.

Occasionally, parts, such as certain automobile parts, will not be self-supporting on the turntable and, in such event, one or more stabilizer members may be movably attached to the turntable for stabilizing such parts. A single stabilizer member 100 is illustrated in FIGS. 5 and 6. The stabilizer member is formed of a bar having a lower section 101 which is bifurcated to fit over one of the planar members 42 forming a radial spoke. This bifurcation results in a pair of fingers 102 and 103 lying one to each side of the planar member 42 and with the fingers at their lower ends extending generally at a right angle to the remainder of the lower section to underlie a pair of the planar members 44 which extend from each side of the planar member 42. An upper section 105 of the stabilizer member for part engagement extends at an angle from the lower section 101 in a direction opposite to said fingers 102 and 103 to have the weight thereof act in a direction to maintain the engagement of the stabilizer member with the planar members of the turntable. When not required, it will be obvious that the stabilizer members can easily be removed merely by rotating a stabilizer member in a counterclockwise direction, as viewed in FIG. 6, to free the angled ends of the fingers from beneath a planar member 44 followed by lifting of the stabilizer member. The stabilizer member 100 has the slot between the fingers 102 and 103 long enough whereby the stabilizer member may also fit over a turntable member 44 or 45. Two of the stabilizer members can be mounted to support a "V-8" engine because of the sloped upper section 105.

Although not forming part of the invention disclosed herein, general reference may be made to additional structure shown generally in the drawings including a control box, indicated generally at 110, having suitable controls for operation of the power washer. The reservoir has an opening 112 in a reservoir cover 113 for placement of filters which filter the liquid before it returns to the system through the pump suction line 14 and the pump 12.

I claim:

1. A power washer for automotive parts and the like having a cabinet with walls and with spray means therein, a circular turntable within the cabinet for support of parts to be washed and having a rim around the perimeter, means for rotatably mounting the turntable, and drive means for the turntable, said spray means including at least one horizontally-extending spray arm and at least one vertically-extending spray arm and each having a series of spray nozzles with the spray nozzles on the horizontally-extending spray arm grouped predominantly adjacent an outer part of the turntable to direct more fluid toward said outer part and the spray nozzles on the vertically-extending spray arm being more closely spaced adjacent the top of the turntable to direct more fluid toward the underside of parts supported on the turntable.

2. A power washer for automotive parts and the like having a cabinet with walls and with spray means therein, a circular turntable within the cabinet for support of parts to be washed and having a rim around the perimeter, means for rotatably mounting the turntable, and drive means for the turntable, said turntable having interconnected planar members with their width extending vertically to provide open spaces therebetween and with a number of said planar members extending at an angle to the other of said planar members, and a stabilizer member in the form of a bar having a bifurcated lower section to fit over a first planar member and with a pair of angled fingers at the end thereof to fit under a second planar member which is at an angle to the first planar member.

3. A power washer as defined in claim 2 wherein said second planar member is of a lesser width than said first planar member to have their lower edges at different levels.

4. A power washer as defined in claim 2 wherein said stabilizer member bar has an upper section extending at an angle to said lower section and in a direction opposite to said fingers.

* * * * *